US008375834B2

(12) United States Patent
Tosu

(10) Patent No.: US 8,375,834 B2
(45) Date of Patent: Feb. 19, 2013

(54) DIE ASSEMBLY

(75) Inventor: Norio Tosu, Kitakyusyu (JP)

(73) Assignee: Mitsui High-Tec, Inc., Fukuoka (JP)

( * ) Notice: Subject to any disclaimer, the term of this patent is extended or adjusted under 35 U.S.C. 154(b) by 382 days.

(21) Appl. No.: 12/681,393

(22) PCT Filed: Oct. 9, 2008

(86) PCT No.: PCT/JP2008/068348

§ 371 (c)(1),
(2), (4) Date: Apr. 2, 2010

(87) PCT Pub. No.: WO2009/048096

PCT Pub. Date: Apr. 16, 2009

(65) Prior Publication Data

US 2010/0218660 A1 Sep. 2, 2010

(30) Foreign Application Priority Data

Oct. 12, 2007 (JP) ..... 2007-266466

(51) Int. Cl.
*B26D 7/06* (2006.01)

(52) U.S. Cl. ..... 83/140; 83/698.31; 83/684

(58) Field of Classification Search ..... 83/526, 83/533, 540, 563, 133, 684, 138, 140, 698.31, 83/566, 567, 452, 460
See application file for complete search history.

(56) References Cited

U.S. PATENT DOCUMENTS 1,806,434 A * 5/1931 Wilczec ..... 83/133
3,472,109 A * 10/1969 Kottsieper et al. ..... 83/540
3,673,902 A * 7/1972 Strobel ..... 83/133
4,104,941 A * 8/1978 Krueger ..... 83/133
4,552,050 A * 11/1985 Grefe ..... 83/685
5,253,559 A * 10/1993 Philippe et al. ..... 83/133
5,303,618 A * 4/1994 Norell ..... 76/107.1
5,749,279 A * 5/1998 Gardner ..... 83/639.1
2003/0000344 A1* 1/2003 Suzuki ..... 76/107.1

(Continued)

FOREIGN PATENT DOCUMENTS

GB 2390318 1/2004
JP 6-54422 7/1994

(Continued)

OTHER PUBLICATIONS

Search report from E.P.O., mail date is Jan. 28, 2011.

*Primary Examiner* — Sean Michalski
(74) *Attorney, Agent, or Firm* — Greenblum & Bernstein P.L.C.

(57) ABSTRACT

A die assembly having a guide rod that includes a lower rod which is fixedly placed on a stripper plate which guides a punch for engagement with a lower die and an upper rod which is placed removably on the stripper plate for engagement with an upper die. When punching a material for punching, the upper rod is removed from the stripper plate so as to put the upper plate and the stripper plate in a disconnected state, i.e., so that the stripper plate is made free to move backwards and forwards relative to the lower die by the lower rod. When the material for punching is not punched, the upper rod is attached to the stripper plate so as to put the upper die and the stripper plate in a connected state by the upper rod, so that the stripper plate is held on to the upper die.

1 Claim, 7 Drawing Sheets

U.S. PATENT DOCUMENTS

| | | | | |
|---|---|---|---|---|
| 2004/0000223 | A1* | 1/2004 | Grant | 83/140 |
| 2004/0069111 | A1* | 4/2004 | Watanabe et al. | 83/669 |
| 2004/0123640 | A1* | 7/2004 | Rooney, Jr. | 72/456 |
| 2004/0154452 | A1* | 8/2004 | Wu et al. | 83/651 |
| 2010/0218660 | A1* | 9/2010 | Tosu | 83/684 |

FOREIGN PATENT DOCUMENTS

| | | |
|---|---|---|
| JP | 7-314057 | 12/1995 |
| JP | 2001-47147 | 2/2001 |
| NL | 9200969 | 1/1994 |

* cited by examiner

DIE ASSEMBLY

TECHNICAL FIELD

The present invention relates to a die assembly comprising an upper die including a punch and a lower die including a die, wherein the upper die mounted on a press ram is connected to the lower die via die-set guides so as to move backwards and forwards, whereby a material for punching which is pressed against the lower die by a stripper plate is punched through reciprocation of the upper die relative to the lower die.

BACKGROUND ART

A conventional die assembly A shown in FIG. 6 includes an upper die U and a lower die L, and the upper die U is connected to the lower die L via die-set guides so as to move backwards and forwards (moves upwards and downwards).

The upper die U includes a punch holder Ua, a punch plate Ub and punches Uc and is mounted on a press ram R of a press, while the lower die L includes a lower die base La and a die Lb and is mounted on a bolster B of the press.

A stripper plate S is provided between the upper die U and the lower die L so as to move backwards and forwards via (moves upwards and downwards) via the die-set guides, and in the die assembly A described above, a thin plate (a material for punching) is pressed against the lower die L by the stripper plate S, and the thin plate is punched by the punches Uc of the upper die U by lowering the upper die U towards the lower die L.

Here, in the conventional die assembly A described above, in the event that the press ram R is slightly inclined or deflected or moves sideways due to wear produced in association with an eccentric load at the time of punching or usage, there is caused a deviation in a positional relationship between the upper die U mounted on the press ram R and the lower die L.

This makes a clearance between the punches Uc of the upper die U and the die Lb of the lower die L uneven, which may cause a fear that not only the generation of a punching failure may occur, but also damage to the punches Uc and the die Lb may also occur.

Since a pilot pin (not shown) which is provided on the upper die U is also caused to move, there is caused deterioration in guiding the pilot pin into a pilot hole (not shown) provided in the lower die L.

These phenomena lead to serious problems with respect to the die assembly for use in punching a thin plate whose thickness is extremely thin, in precision punching which requires a small clearance between the punches and the die and in punching a product which requires severe dimension and shaping accuracies.

Then, with a view to solving the aforesaid problems, there is provided a die assembly in which a stripper plate for guiding punches when punching a material for punching are provided on a lower die so as to move backwards and forwards (refer to Patent Document 1: JP-A-2001-47147).

In a die assembly A shown in FIG. 7, a stripper plate S is installed between an upper plate U and a lower plate L, and guide rods Sg, Sg which extend downwards are provided on the stripper plate S.

These guide rods Sg, Sg fit in guide guide bushings Lc, Lc provided in the lower die base La so as to rise and fall, and the stripper plate S is provided so as to move backwards and forwards (moves upwards and downwards) relative to the lower die L by the guide rods Sg, Sg being guided by the guide bushings Lc, Lc.

In addition, the punches Uc, Uc on the upper die U fit in the stripper plate S so as to move backwards and forwards (moves upwards and downwards), whereby the stripper plate S guides the punches Uc, Uc on the upper die U at the time of punching. Further, the stripper plate S also guides a pilot pin (not shown) provided on the upper die U.

According to the configuration of the aforesaid die assembly A, due to the punches Uc on the upper die U being guided by the stripper plate S which is not connected to the press ram R, the positional relationship between the upper die U and the lower die L is maintained without being affected by the inclination or deflection or sideways movement of the press ram R.

Consequently, the generation of a punching failure or damage to the punches/die can be prevented which would otherwise be caused by the inclination or deflection of sideways movement of the press ram R, and even with a thin material for punching, punching with good dimension accuracy and shaping accuracy is enabled.

Patent Document 1: JP-A-2001-47147

DISCLOSURE OF THE INVENTION

Problem that the Invention is to Solve

Incidentally, in the conventional die assembly shown in FIG. 7, since the stripper plate S for guiding the punches Uc on the upper die U is not connected to the press ram R, there has been caused a problem that the punches break or chip (fracture) due to the stripper plate S moving sideways or being inclined by vibrations or impact produced during transportation, for example.

When adjusting replacement punches Uc on the upper die U for registration with the stripper place S or regrinding the punches Uc for maintenance, the stripper plate needs to be held to be positioned relative to the upper die U. However, in the conventional die assembly shown in FIG. 7, there is provided no means for holding the stripper plate S on to the upper die U, and hence there has been a problem that something unfavorable may occur in the maintenance.

In view of the actual situations described above, an object of the invention is to provide a die assembly which can prevent the occurrence of a punching failure or damage to punches or a die which is attributed to inclination or sideways movement of a press ram when a punching operation is performed while preventing damage to the punches which is attributed to sideways movement or inclination of a stripper plate when no punching operation is performed and which can facilitate the adjustment of the punches for registration with the stripper plate for maintenance.

Means for Solving the Problem

With a view to attaining the object, according to the invention, there is provided a "die assembly" comprising an upper die including a punch and a lower die including a die wherein the upper die mounted on a press ram is connected to the lower die via a die-set guide so as to move backwards and forwards and a material for punching which is pressed against the lower die by a stripper plate is punched through reciprocation of the upper die relative to the lower die, wherein the die assembly comprises a guide rod made up of a lower rod which is fixedly placed on the stripper plate which guides the punch for engagement with the lower die and an upper rod which is placed removably on the stripper plate for engagement with the upper die, and in that when punching the material for punching, the upper rod is removed from the stripper plate so as to put the upper plate and the stripper plate in a disconnected state, so that the stripper plate is made free to move backwards and forwards relative to the lower die by the lower rod, while when the material for punching is not punched, the upper rod is attached to the stripper plate so as to put the upper die and the stripper plate in a connected state by the upper rod, so that the stripper plate is held on to the upper die.

Advantage of the Invention

According to the die assembly to which the invention relates, when the material for punching is punched, the upper rod is removed fro the stripper plate so as to put the upper die and the stripper plate in the disconnected state, so that the stripper plate is made free to move backwards and forwards relative to the lower die by the lower rod, whereby by the punch on the upper die being guided by the stripper plate which is disconnected from the press ram when the punching is performed, the positional relationship between the upper die and the lower die is maintained without being affected by inclination or deflection, or sideways movement of the press ram. Consequently, the generation of a punching failure or damage to the punch or the die can be prevented which would otherwise be caused by inclination or deflection, or sideways movement of the press ram. In addition, even when the material for punching is a thin material, the material for punching can be punched with good dimension accuracy and shaping accuracy.

On the other hand, when the material for punching is not punched, the upper rod is attached to the stripper plate so as to put the upper die and the stripper plate in the connected state by the upper rod, so that the stripper plate is held on to the upper die, whereby the generation of a punch break can be prevented which would otherwise be caused by inclination or deflection, or sideways movement of the press ram which is attributed to vibrations or impact during transportation, but also adjustment of a replaced punch for registration with the stripper plate or regrinding of the punch for maintenance can be carried out easily and accurately by the stripper plate being positioned relative the upper die when the maintenance above is carried out.

Note that putting the upper die and the stripper plate in the "disconnected state" denotes a state in which an object, which transfers the inclination or deflection of the press ram to the stripper plate, is not interposed between the upper die and the stripper plate. In reality, however, the stripper plate is suspended from the upper die via a suspension bolt so as not to fall.

DESCRIPTION OF REFERENCE NUMERALS AND CHARACTERS

1 die assembly; 2 upper die; 2*a* punch holder; 2*b* punch plate; 2*c* punch; 3 lower die; 3*a* lower die base; 3*b* die; 4 die-set guide; 5 stripper plate; 6 guide rod; 6*a* lower rod; 6*b* upper rod; R press ram; B bolster

BEST MODE FOR CARRYING OUT THE INVENTION

Hereinafter, the invention will be described in detail based on the drawings which depict an embodiment.

Figure 1:
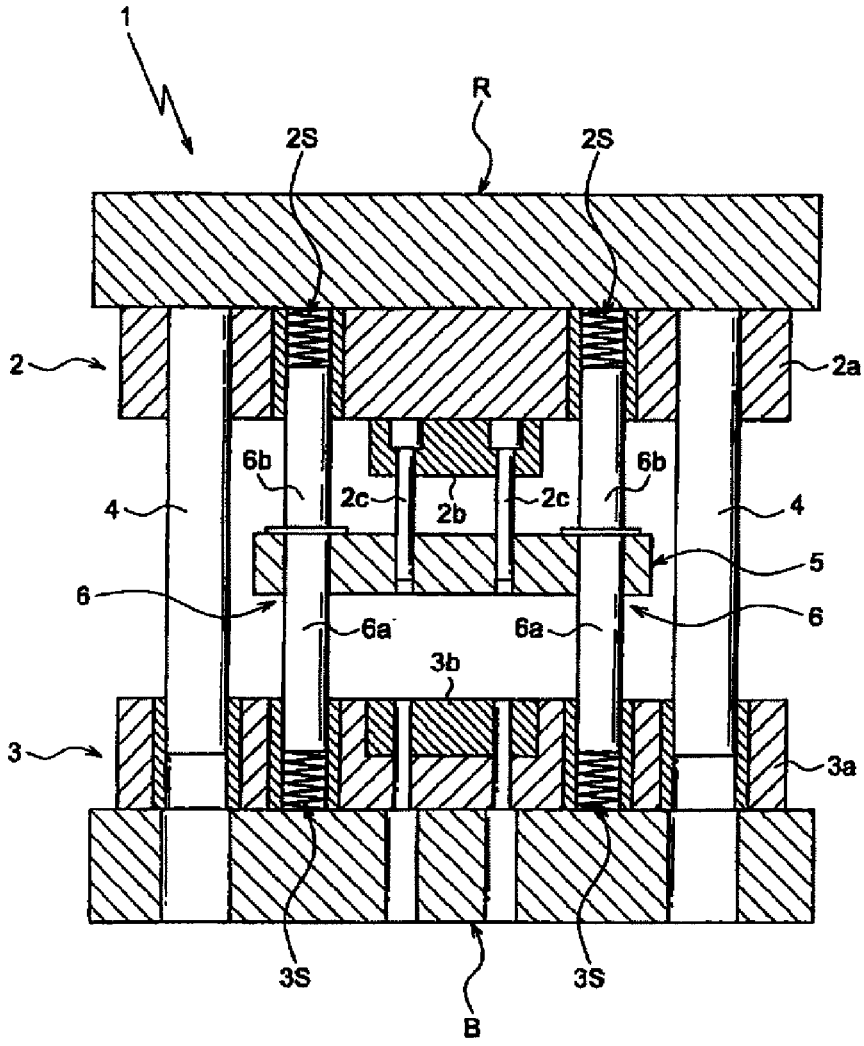
FIG. 1 An overall conceptual drawing showing a state in which upper rods of guide rods are attached in a die assembly according to the invention.

As shown in FIG. 1, a die assembly 1 according to the invention includes an upper die 2 and a lower die 3, and the upper die 2 is connected to the lower die 3 via die-set guides 4, 4 . . . so as to move backwards and forwards (moves upwards and downwards).

The upper die 2 is mounted on a press ram R of a press and includes a punch holder 2*a* which is fixed to the press ram R and punches 2*c* which are mounted on the punch holder 2*a* via a punch plate 2*b*.

On the other hand, the lower die 3 is mounted on a bolster B of the press and includes a lower die base 3*a* which is fixed to the bolster B and a die 3*b* which is fixed to the lower die base 3*a*.

A stripper plate 5 is provided between the upper die 2 and the lower die 3, and guide rods 6, 6, which are each made up of a lower rod 6*a* which extends downwards for engagement with the lower die 3 and an upper rod 6*b* which extends upwards for engagement with the upper die 2, are installed in the stripper plate 5.

In addition, the punches 2*c*, 2*c* on the upper die 2 fit in the stripper plate 5 so as to move backwards and forwards (moves upwards and downwards), and when a material for punching is punched, the stripper plate 5 guides the punches 2*c*, 2*c*.

Further, the stripper plate 5 also guides a pilot pin (not shown) which is provided on the upper die 2. In addition, the stripper plate 5 is held on to the upper die 2 by stripper suspension bolts, not shown.

Figure 2:
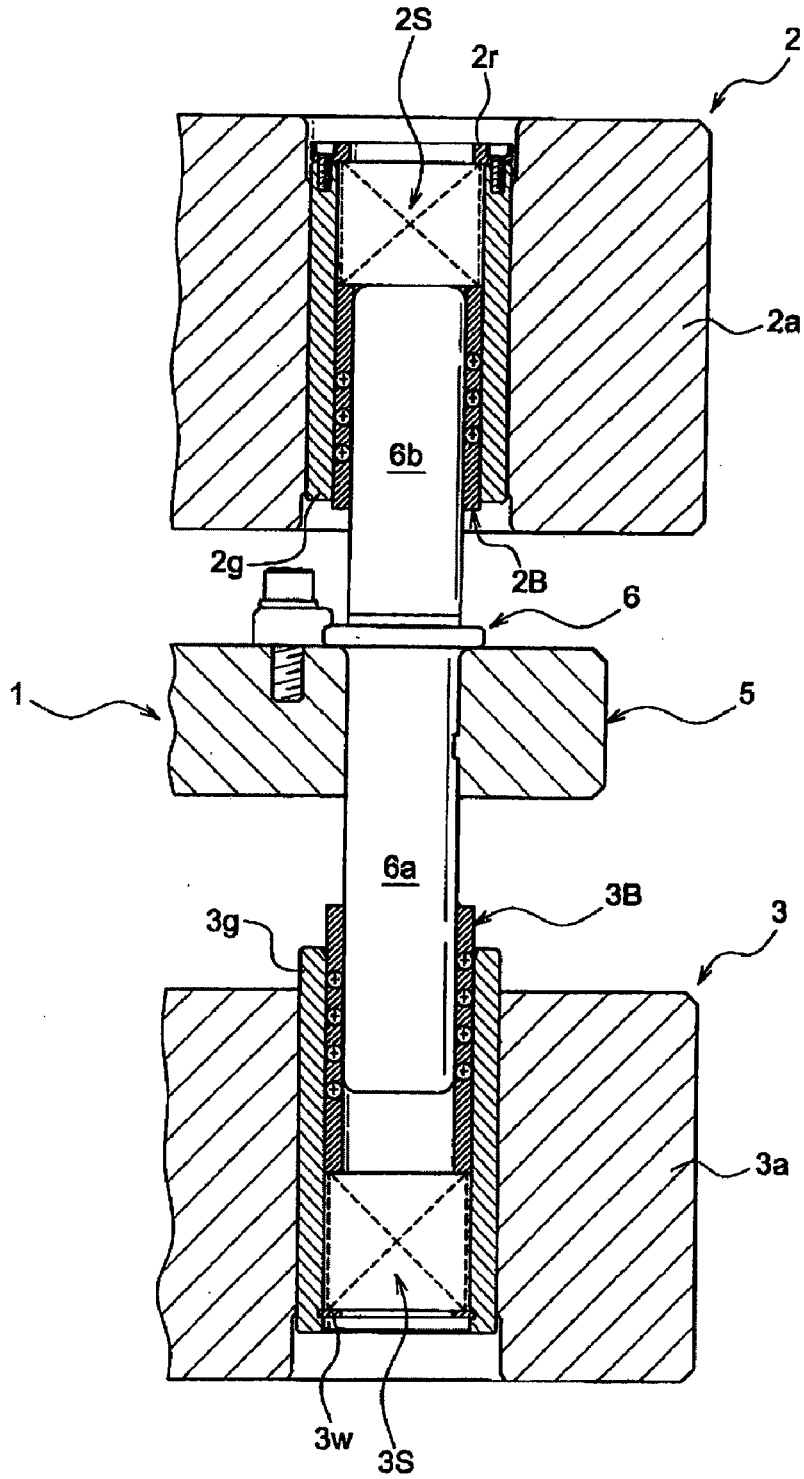
FIG. 2 A front view of a main part shown by partially cutting away the die assembly shown in FIG. 1.
Figure 3:
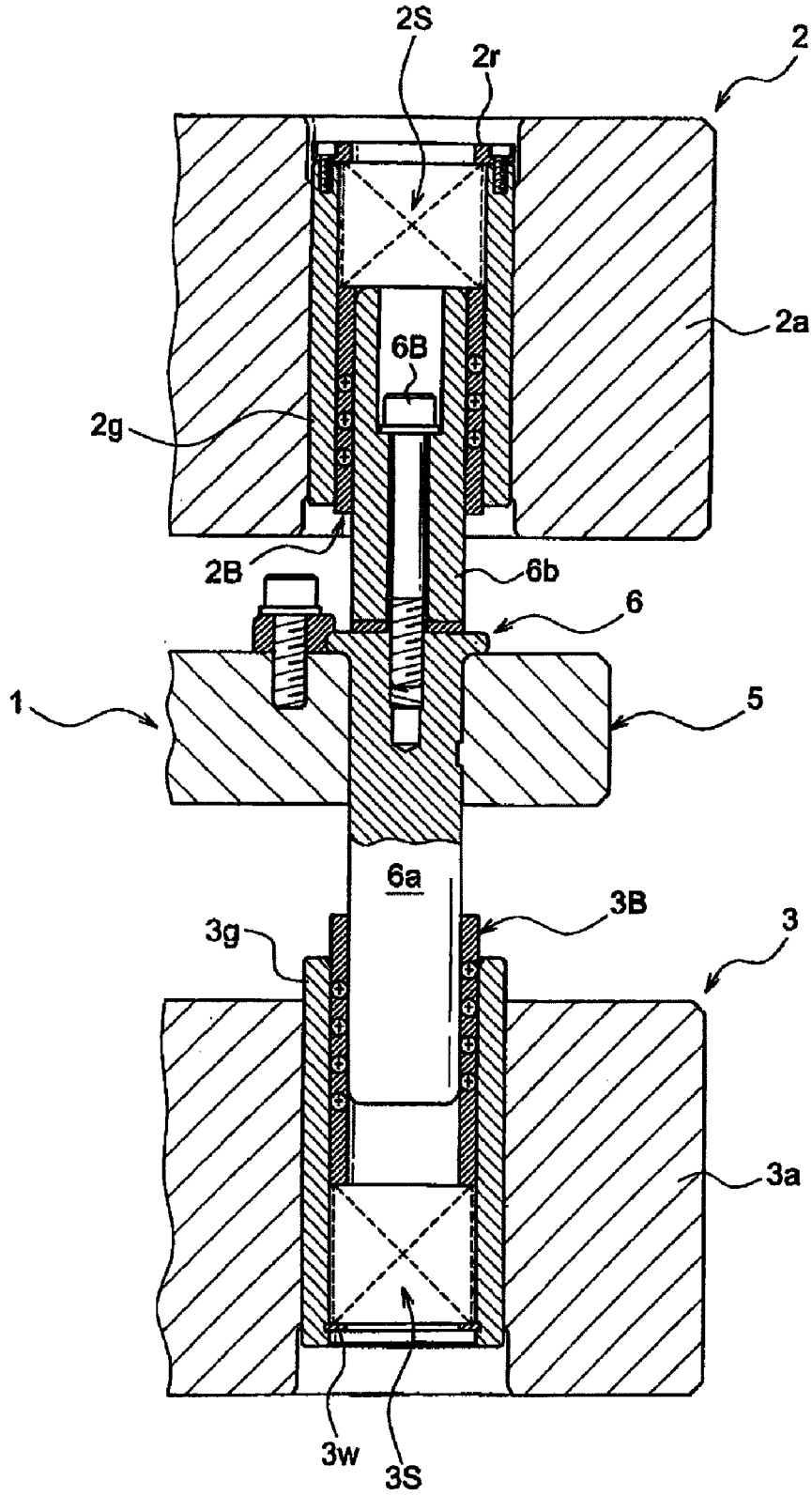
FIG. 3 A front view of the main part shown by partially cutting away the die assembly shown in FIG. 1.

As shown in FIGS. 2 and 3, the lower rods 6*a*, 6*a* which make up the guide rods 6, 6 are fixedly installed in the stripper plate 5 so as not to move relative thereto, and lower end portions thereof are fitted in guide bushings 3*g*, 3*g* provided in the lower die base 3*a* via ball bearings 3B, 3B.

Namely, the stripper plate 5 is provided so as to move backwards and forwards (moves upwards and downwards) relative to the lower die 3 by the lower rods 6*a* of the guide rods 6 being guided by the guide bushings 3*g* via the ball bearings 3B.

Springs 3S are provided below the lower rods 6*a* which are fixedly installed in the striper plate 5 for assisting in restoring the stripper plate 5 to the normal condition, and the springs 3S are supported in interiors of the guide bushings 3*g* by retaining washers 3*w*.

On the other hand, the upper rods 6*b*, 6*b*, which make up the guide rods 6, 6, are removably installed on the stripper plate 5, and specifically, the upper rods 6*b* are removably fixed to upper ends of the lower rods 6*a* which are fixedly installed in the stripper plate 5 as has been described above.

In addition, upper end portions of these upper rods 6*b*, 6*b* are fitted in guide bushings 2*g*, 2*g* which are provided in the punch holder 2*a* of the upper die 2 via ball bearings 2B, 2B.

Here, the stripper plate 5 and the upper die 2 are put in a connected state by the upper rods 6*b* of the guide rods 6 being fitted in the guide bushings 2*g*.

The stripper plate 5 is provided so as to move backwards and forwards (moves upwards and downwards) relative to the upper die 2 by the upper rods 6*b* being guided by the guide bushings 2*g* via the ball bearings 2B, and springs 2S are provided above the upper rods 6*b* for assisting in suppressing upward and downward movements of the stripper plate 5, these springs 2S being supported in interiors of the guide bushings 2*g* by lid members 2*r* which are fastened with screws.

In the die assembly configured in the way described above, when punching is carried out on a material for punching, firstly, as is shown in FIGS. 1 to 3, the upper rods 6*b* which are attached to the stripper plate 5 are removed from the stripper plate 5 by loosening bolts 6B and the ball bearings 2B and the springs 2S are removed.

In this way, by removing the upper rods 6*b* from the stripper plate 5, the upper die 2 and the stripper plate 5 are disconnected from each other, whereby the stripper plate 5 is allowed to move backwards and forwards (move upwards and downwards) relative to the lower die 3 by the lower rods 6*a* being guided by the wide bushings 3*g* (the ball bearings 3B).

Figure 4:
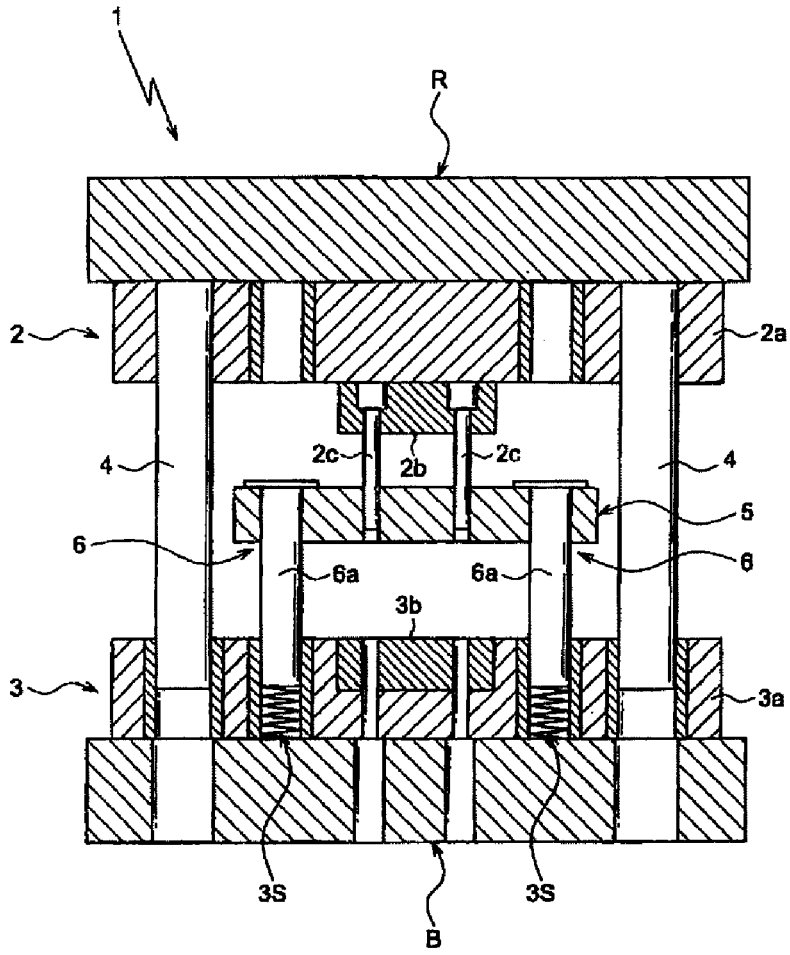
FIG. 4 An overall conceptual drawing showing a state in which the upper rods of the guide rods are removed in the die assembly according to the invention.
Figure 5:
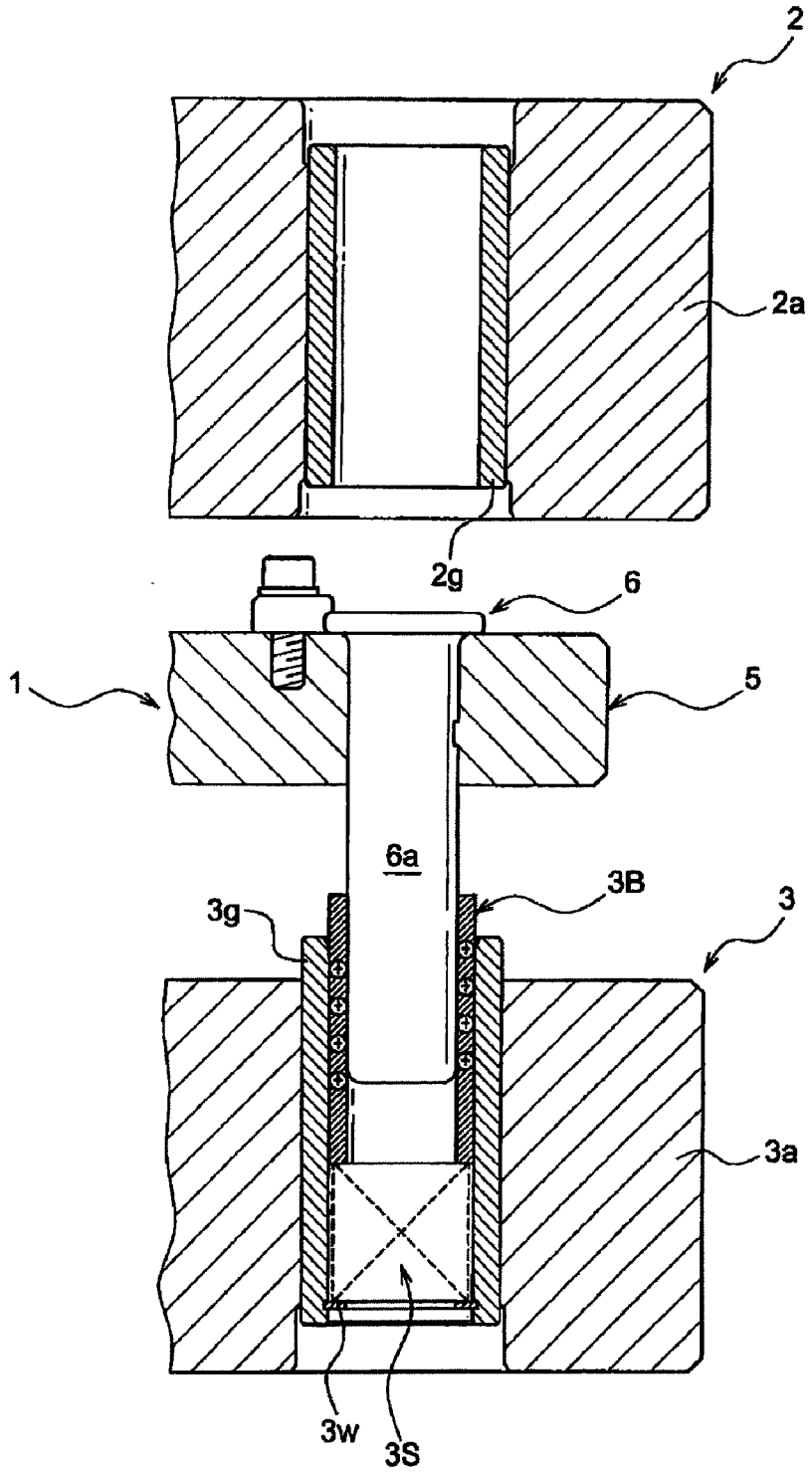
FIG. 5 A front view of the main part shown by partially cutting away the die assembly shown in FIG. 4.
Figure 6:
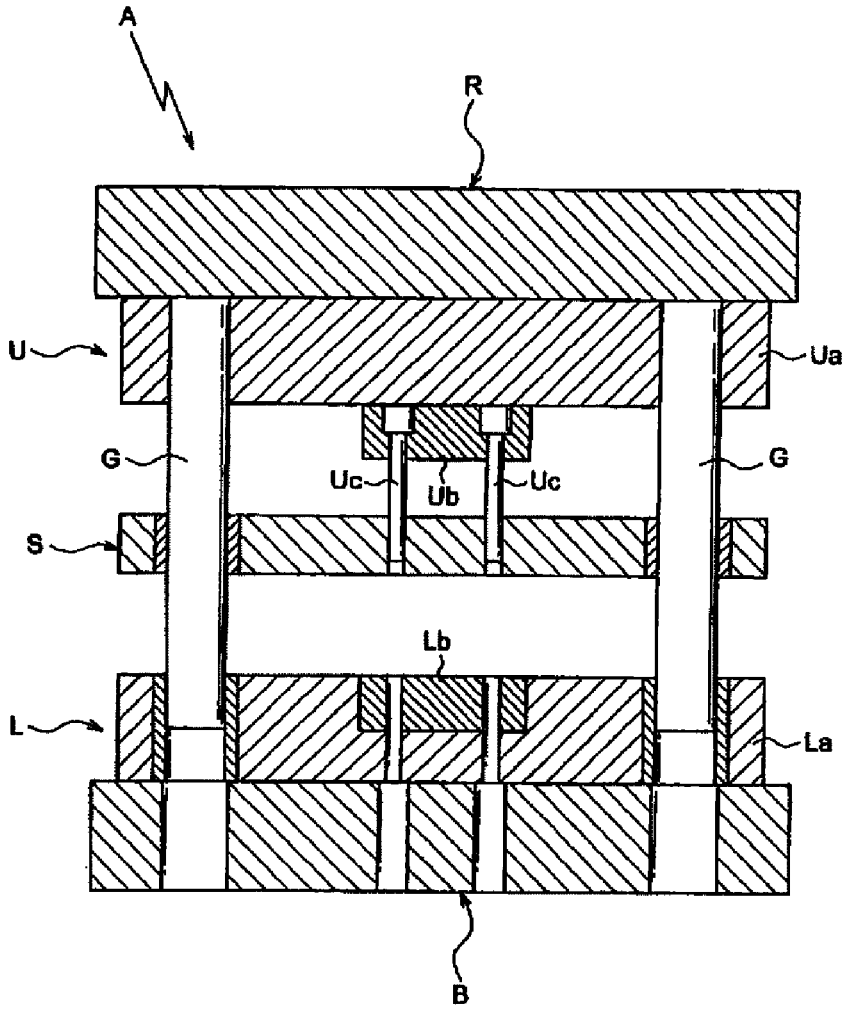
FIG. 6 An overall conceptual drawing showing a conventional die assembly.
Figure 7:
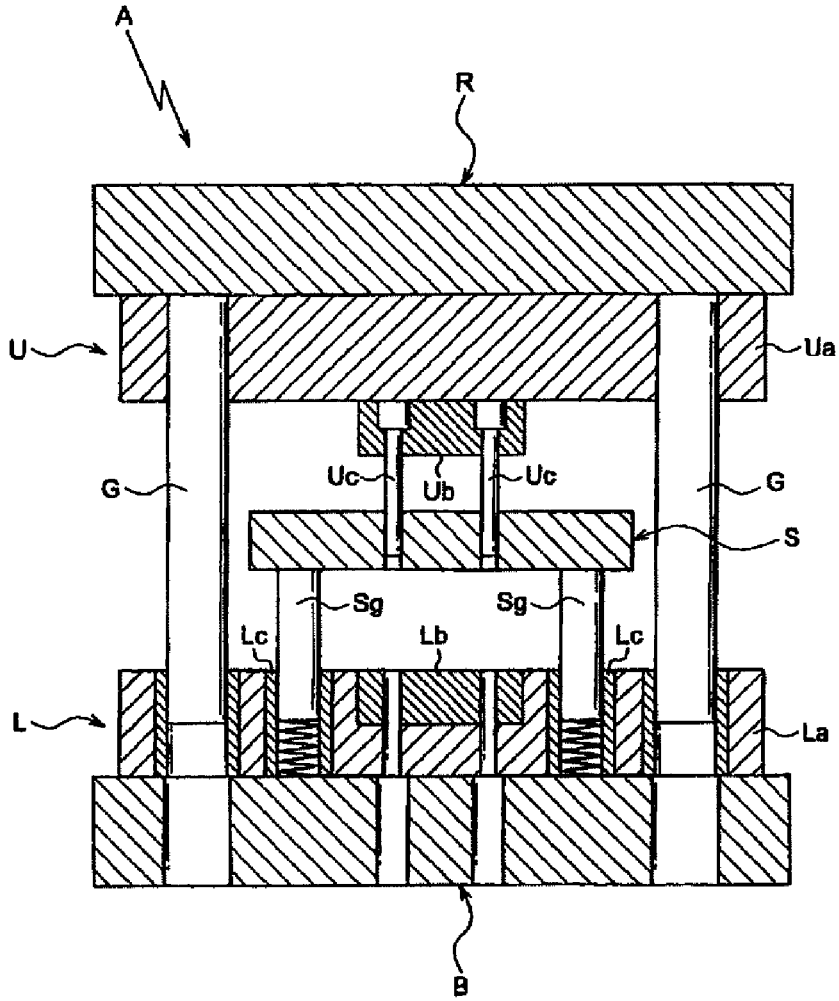
FIG. 7 An overall conceptual drawing showing a conventional die assembly.

As is shown in FIGS. 4 and 5, after the upper rods 6*b* are removed from the stripper plate 5, a thin plate (a material for punching) is pressed against the lower die 3 (the die 3*b*) by the stripper plate 5, and by causing the upper die 2 to descend relative to the lower die 3, punching the thin plate is carried out by the punches 2*c* on the upper die 2.

Here, the upper die 2, or specifically the punches 2*c*, 2*c* on the upper die 2 which are caused to descend when punching the thin plate are guided by the stripper plate 5.

On the other hand, the stripper plate 5, which guides the punches 2*c*, 2*c* on the upper die 2 when the thin plate is punched, is supported on the lower die 3 via the lower rods 6*a*, 6*a* as has been described above.

Namely, since the punches 2*c*, 2*c* on the upper die 2 which descends when punching is performed are guided by the stripper plate 5 which is being disconnected from the press ram R on which the upper die 2 is mounted, the punches 2*c*, 2*c* are not affected by inclination or deflection, or sideways movement of the press ram R, and there is generated no deviation in the positional relationship between the punches 2*c*, 2*c* and the die 3*b* on the lower die 3.

Thus, according to the die assembly 1 having the configuration described above, unevenness in clearance between the punches 2*c* and the die 3*b* and the generation of a punching failure or damage to the upper die 2 (the punches 2*c*) and the lower die 3 (the die 3*b*) can be prevented which would otherwise be caused by inclination or deflection, or sideways movement of the press ram R.

In addition, since the clearance between the punches 2*c* and the die 3*b* is maintained uniformly in a designed condition, even when an extremely thin plate is punched or a narrow plate is punched, punching thereon can be performed with good dimension accuracy and shaping accuracy.

On the other hand, in the die assembly configured as has been described above, when various types of maintenance are performed which includes adjustment of replaced punches 2*c* for registration with the stripper plate 5, as is shown in FIGS. 1 to 3, the upper rods 6*b* which make up the guide rods 6 are fixedly installed on the stripper plate 5 (upper portions of the lower rods 6*a*) by tightening the bolts 6B.

Here, the stripper plate 5 and the upper die 2 are put in a connected state by upper portions of the upper rods 6*b* which are fixedly installed on the stripper plate 5 being fitted in the guide bushings 2*g* (the ball bearings 2B) which are provided in the upper die 2 (the punch holder 2*a*).

In this way, by attaching the upper rods 6*b* to the stripper plate 5 and holding the stripper plate 5 in the connected state with the upper die 2, even in the event that vibrations generated during transportation of the die assembly 1 or impact generated during placing work of the die assembly 1, for example, is exerted on the stripper plate 5, the generation of an abrupt sideways movement or inclination of the stripper plate 5 can be suppressed, and hence, a problem that the punches break or chip (fracture) due to the stripper plate 5 moving sideways or being inclined can be prevented.

In addition, for example, even when adjusting replaced punches 2*c* for registration with the stripper plate 5 or regrinding the punches for maintenance, as has been described above, the stripper plate 5 is held on to the upper die 2 by the upper rods 6*b* attached to the stripper plate 5, so that the stripper plate 5 is positioned relative to the upper die 2. Therefore, the aforesaid maintenance ca be performed easily and accurately.

Incidentally, in the die assembly 1 having the configuration described above, the guide rod 6 is given a two-part construction in which the guide rod 6 is made up of the lower rod 6*a* and the upper rod 6*b* and the upper rod 6*b* is fixed to an upper end of the lower rod 6*a* by use of the bolt 6B. Therefore, when performing punching on a material for punching, even in such a state that the upper rods 6*b* are attached to the striper plate 5, when a load is exerted on the upper rods 6*b* when a punching operation is performed, the bolts 6B which fix the upper rods 6*b* deflect, and the overall rigidity at the guide rods 6 is reduced, whereby inclination or deflection of the press ram R is absorbed.

In this way, because the guide rods 6 absorb the inclination or deflection of the press ram R, the punches 2*c*, 2*c* on the upper die 2 which descend when punching is performed are not affected by the inclination or deflection of the press ram S, and there is caused no deviation in the positional relationship of the punches 2*c* with the die 3*b* in the lower die 3. Therefore, the generation of a punching failure can be prevented.

In the embodiment that has been described heretofore, although the upper rods 6*b* which make up the guide rods 6 are installed so as to be removably attached to the lower rods 6*a* which are fixedly installed in the stripper plate 5 using the bolts 6B so that the upper rods 6*b* are installed so as to be removably attached to the stripper plate 5 via the lower rods 6*a*, the upper rods 6*b* which make up the guide rods 6 can, needless to say, be designed so as to be directly attached to and removed from the stripper plate.

The invention claimed is:

1. A die assembly, comprising:

an upper die including a punch and a lower die including a die wherein the upper die mounted on a press ram is connected to the lower die via a die-set guide so as to move backwards and forwards and a stripper plate configured to press a material to be punched against the lower die so as to punch the material through reciprocation of the upper die relative to the lower die, wherein the die assembly comprises a guide rod made up of a lower rod which is fixedly placed on the stripper plate which guides the punch for engagement with the lower die and an upper rod which is placed removably on the stripper plate for engagement with the upper die, and when punching the material for punching, the upper rod is removed from the stripper plate so as to put the upper plate and the stripper plate in a disconnected state, so that the stripper plate is made free to move backwards and forwards relative to the lower die by the lower rod, while when the material for punching is not punched, the upper rod is attached to the stripper plate so as to put the upper die and the stripper plate in a connected state by the upper rod, so that the stripper plate is held on to the upper die.

* * * * *